US008351642B2

(12) United States Patent
Funahashi

(10) Patent No.: US 8,351,642 B2
(45) Date of Patent: Jan. 8, 2013

(54) SPEAKER

(75) Inventor: Osamu Funahashi, Mie (JP)

(73) Assignee: Panasonic Corporation, Osaka (JP)

( * ) Notice: Subject to any disclaimer, the term of this patent is extended or adjusted under 35 U.S.C. 154(b) by 289 days.

(21) Appl. No.: 12/738,713

(22) PCT Filed: Dec. 3, 2008

(86) PCT No.: PCT/JP2008/003570
§ 371 (c)(1),
(2), (4) Date: Apr. 19, 2010

(87) PCT Pub. No.: WO2009/072275
PCT Pub. Date: Jun. 11, 2009

(65) Prior Publication Data

US 2010/0215207 A1 Aug. 26, 2010

(30) Foreign Application Priority Data

Dec. 3, 2007 (JP) ..... 2007-312105
Mar. 12, 2008 (JP) ..... 2008-062164

(51) Int. Cl.
*H04R 11/02* (2006.01)

(52) U.S. Cl. ..... 381/400; 381/398; 381/423; 381/424; 381/430

(58) Field of Classification Search ..... 381/409, 381/335, 345, 351, 398, 403, 405, 412, 413, 381/418, 417, 423, 424, 430
See application file for complete search history.

(56) References Cited

U.S. PATENT DOCUMENTS

| | | | | |
|---|---|---|---|---|
| 3,482,062 | A * | 12/1969 | Hecht | 381/162 |
| 5,513,266 | A * | 4/1996 | Zuroski | 381/71.5 |
| 5,550,332 | A * | 8/1996 | Sakamoto | 181/148 |
| 5,715,324 | A * | 2/1998 | Tanabe et al. | 381/412 |
| 5,940,522 | A * | 8/1999 | Cahill et al. | 381/397 |
| 2002/0071587 | A1 * | 6/2002 | Wang | 381/396 |
| 2005/0078849 | A1 * | 4/2005 | Funahashi et al. | 381/412 |
| 2005/0201588 | A1 * | 9/2005 | Funahashi et al. | 381/423 |
| 2006/0274914 | A1 * | 12/2006 | Horigome et al. | 381/424 |
| 2008/0317275 | A1 * | 12/2008 | Funahashi | 381/398 |

FOREIGN PATENT DOCUMENTS

| | | |
|---|---|---|
| CN | 1302523 A | 7/2001 |
| JP | 48-16835 | 2/1973 |

(Continued)

*Primary Examiner* — Mohamad Musleh
*Assistant Examiner* — Mangtin Lian
(74) *Attorney, Agent, or Firm* — RatnerPrestia

(57) ABSTRACT

In a speaker, a first space enclosed by the surface of a second edge close to a magnetic circuit body, a suspension holder, the outer circumferential surface of a voice coil body, the magnetic circuit body, and a frame is airtight to the atmosphere outside the speaker, to make a first space function as an air suspension. The voice coil body is supported with a first edge and a second edge, and with the aid of the springiness of gas inside a first space. Hence, an equivalent, low Young's modulus can be set to the first edge and the second. Consequently, deformation of the diaphragm connected to the first edge is reduced during sound reproduction, thereby reducing disturbance in frequency response in the middle and high ranges.

7 Claims, 5 Drawing Sheets

FOREIGN PATENT DOCUMENTS

| | | | |
|---|---|---|---|
| JP | 59-077797 | A | 5/1984 |
| JP | 03-109000 | A | 5/1991 |
| JP | 04-220899 | A | 8/1992 |
| JP | 11-008898 | A | 1/1999 |
| JP | 11-150791 | A | 6/1999 |
| JP | 11-262092 | A | 9/1999 |
| JP | 2000-253490 | A | 9/2000 |
| JP | 2000-278792 | A | 10/2000 |
| JP | 2005-039405 | A | 2/2005 |
| JP | 2007-088674 | A | 4/2007 |

* cited by examiner

SPEAKER

This application is a U.S. National Phase Application pf PCT International Application No. PCT/JP2008/003570.

TECHNICAL FIELD

The present invention relates to a speaker.

BACKGROUND ART

FIG. 5 is a sectional view of a conventional speaker. In FIG. 5, the conventional speaker includes voice coil body 504 with coil part 503 movably disposed in magnetic gap 502 formed by magnetic circuit body 501; diaphragm 508 connected to the outer circumferential surface of voice coil bobbin 505 of voice coil body 504 and connected to frame 507 through edge 506; and corrugated damper 509 placed closer to magnetic circuit body 501 than from diaphragm 508, connected to the outer circumferential surface of voice coil bobbin 505 and to frame 507.

Passing an AC current with a sound signal added thereto through coil part 503 of voice coil body 504 causes voice coil body 504 to vibrate vertically. The vertical vibration of voice coil body 504 is transmitted to diaphragm 508, which vibrates air to reproduce sound.

In such a conventional speaker, damper 509 supports voice coil body 504 together with a complex of diaphragm 508 and edge 506, and follows vibration of voice coil body 504 by means of the corrugated structure expanding and contracting during sound reproduction. Information on prior art documents related to the patent application includes FIG. 8 in patent literature 1.

With the conventional speaker, the Young's modulus of damper 109 needs to be high (rigid) to some extent in order to support voice coil body 104. With the high Young's modulus of damper 509, vertical amplitude of voice coil body 504 higher than a certain level during sound reproduction rapidly increases the movable load, which makes it difficult for voice coil body 504 to vibrate faithfully according to an input signal. Consequently, the speaker creates distortion during sound reproduction.

FIG. 6 is a sectional view of another conventional speaker. In FIG. 6, the speaker includes voice coil body 603 with the coil part movably disposed in magnetic gap 602 formed by magnetic circuit body 601; diaphragm 606 connected to the outer circumferential surface of the voice coil bobbin of voice coil body 603 and connected to frame 605 through first edge 604; and damper 608 placed closer to magnetic circuit body 601 than from voice coil body 603, connected to the side surface of voice coil body 603, and connected to frame 605 through second edge 607. First edge 604 projects in the direction opposite to that of second edge 607 to make vertical amplitude of diaphragm 606 symmetric, thereby reducing distortion with the speaker. Here, information on prior art documents related to the patent application includes patent literature 2.

With the above-described speaker, in order to reduce distortion created during sound reproduction, it is important to make vertical amplitude of diaphragm 606 symmetric, and the Young's modulus of first edge 604 is preferably nearly equal to that of a complex formed of damper 8 and second edge 607.

Here, first edge 604 and a complex formed of damper 608 and second edge 607 need enough rigidity to support voice coil body 603 and have a high Young's modulus, and thus first edge 604 unlikely deforms following vertical amplitude of voice coil body 603. Consequently, diaphragm 606 connected to first edge 604 deforms during sound reproduction, causing disturbance in frequency response in the middle and high ranges.

Under the circumstances, reducing the Young's modulus of first edge 604 requires reducing that of the complex formed of damper 608 and second edge 607 as well. This is because the Young's modulus of first edge 604 is preferably nearly equal to that of the complex.

However, first edge 604 and the complex formed of damper 608 and second edge 607, with their Young's moduli thus reduced, are unable to well support voice coil body 603.

[Patent literature 1] Japanese Patent Unexamined Publication No. H11-150791

[Patent literature 2] Japanese Patent Unexamined Publication No. 2007-88674

SUMMARY OF THE INVENTION

The present invention reduces distortion during sound reproduction by a speaker.

A speaker according to the present invention includes a frame; a magnetic circuit body supported by the frame; a voice coil body with its coil part movably disposed in a magnetic gap formed by the magnetic circuit body; a dust cap provided so as to block the opening of the voice coil bobbin of the voice coil body; a diaphragm having an inner circumference connected to the outer circumferential surface of the voice coil bobbin of the voice coil body; a first edge having an inner circumferential end connected to the outer circumference of the diaphragm, having an outer circumferential end connected to the frame; and a connecting member placed closer to the magnetic circuit body than from the diaphragm, having an inner circumferential end connected to the outer circumferential surface of the voice coil bobbin of the voice coil body, and having an outer circumferential end connected to the frame. The speaker has a first space airtight to the atmosphere outside the speaker, functioning as an air suspension, where the first space is enclosed by the surface of the connecting member close to the magnetic circuit body, the outer circumferential surface of the voice coil body, the magnetic circuit body, and the frame.

According to the present invention, distortion during sound reproduction by a speaker is reduced.

REFERENCE MARKS IN THE DRAWINGS

| | |
|---|---|
| 9, 301 | Frame |
| 9a, 301a | Lower frame part |
| 9b, 301b | Upper frame part |
| 9c, 302 | Opening |
| 10, 303 | Magnetic circuit body |
| 10a, 303a | Plate |

-continued

| | |
|---|---|
| 10b, 303b | Magnet |
| 10c, 303c | Yoke |
| 11, 304 | Magnetic gap |
| 12, 305 | Voice coil body |
| 12a, 305a | Voice coil bobbin |
| 12b, 305b | Coil |
| 13, 306 | Dust cap |
| 14, 308 | Fine braided wire |
| 15, 307 | Diaphragm |
| 16, 309 | First edge |
| 17 | Second edge (connecting member) |
| 310 | Sealing member (connecting member) |
| 18 | Suspension holder (connecting member) |
| 19, 312 | Communication space |
| 20, 311 | First space |
| 21, 313 | Gap |
| 22, 314 | Second space |

DETAILED DESCRIPTION OF PREFERRED EMBODIMENTS

First Exemplary Embodiment

Hereinafter, a description is made of the configuration of a speaker according to the first exemplary embodiment of the present invention.

Figure 1:
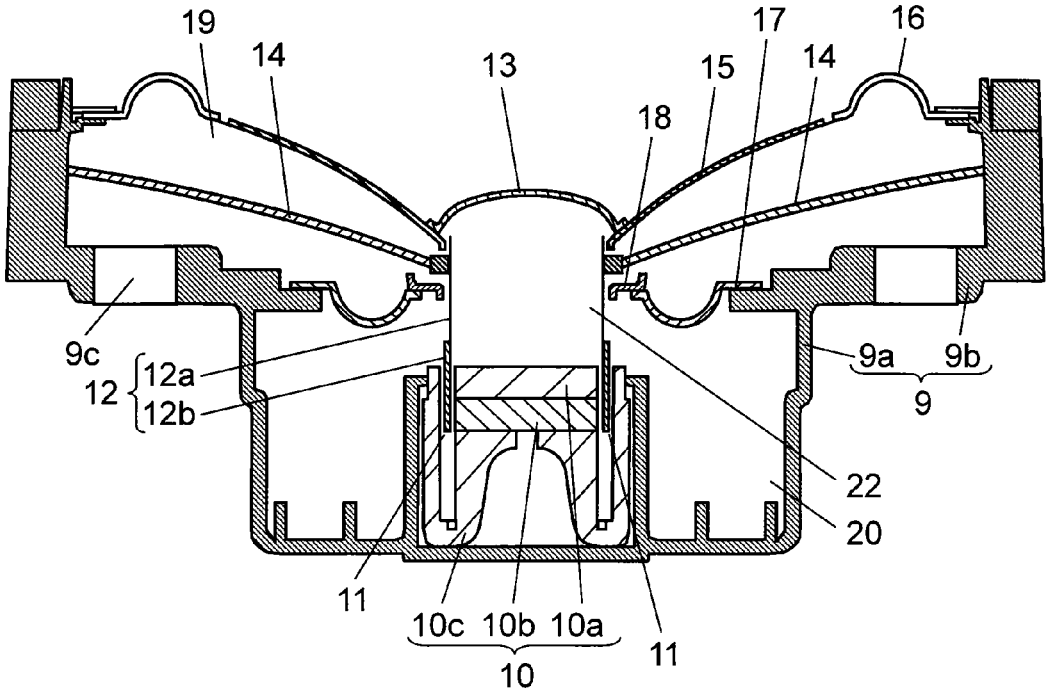
FIG. 1 is a sectional view of a speaker according to the first exemplary embodiment of the present invention.

FIG. 1 is a sectional view of the speaker according to the first embodiment of the present invention. In FIG. 1, the speaker according to the present invention supports the voice coil body, additionally with the first edge and the second edge (i.e. connecting members), with the aid of the springiness of gas inside the space enclosed by the surface of the second edge close to the magnetic circuit body, suspension holder, outer circumferential surface of the voice coil body, magnetic circuit body, and frame. Compared to a conventional speaker, this structure allows reducing a load exerted on the first and second edges to support the voice coil body. Hence, even if a low Young's modulus is set to the first and second edges nearly equally, this structure can support the voice coil body.

Consequently, the diaphragm connected to the first edge is less likely to deform during sound reproduction, thereby reducing disturbance in frequency response in the middle and high ranges.

Frame 9 of the speaker according to the first embodiment has a shape formed by overlaying bottomed, cylinder-shaped lower frame part 9*a* onto bottomed, dish-shaped upper frame part 9*b* with a diameter larger than that of part 9*a*. Upper frame part 9*b* is provided therein with openings 9*c* communicating with outside air.

Magnetic circuit body 10 is placed in the center of the bottom of lower frame part 9*a* and is formed by bonding disk-shaped plate 10*a*, disk-shaped magnet 10*b*, and cylinder-shaped yoke 10*c* in combination. Magnetic circuit body 10 forms cylinder-shaped magnetic gap 11 from the outer circumferential surface of plate 10*a* toward the inner circumferential surface of yoke 10*c*.

Voice coil body 12 is formed of cylinder-shaped voice coil bobbin 12*a* and coil 12*b* wound around the outer circumferential surface of voice coil bobbin 12*a*, where coil 12*b* is disposed movably with respect to magnetic gap 11. Above voice coil body 12, hemispherical dust cap 13 is disposed connecting to diaphragm 15 so as to cover the upper opening of voice coil bobbin 12*a*, thereby preventing dust and moisture from ingressing into magnetic gap 11 through the upper opening of voice coil body 12. Here, fine braided wire 14 of coil 12*b* is drawn out from the upper part of voice coil body 12 to the outside of frame 9.

Diaphragm 15 is cone-shaped and its inner circumference is connected to the outer circumferential surface of voice coil body 12. Diaphragm 15 generates sound by vertically vibrating during sound reproduction by the speaker, containing mainly pulp and resin balancing high rigidity with low internal loss.

The inner circumferential end of first edge 16 is connected to the outer circumference of diaphragm 15, and first edge 16 is formed of a material such as urethane foam resin, foamed rubber, and SBR rubber so as not to exert a movable load on diaphragm 15 during sound reproduction. Further, the outer circumferential end of first edge 16 is connected to the vicinity of the top end of the inner circumferential surface of upper frame part 9*b*, supported by frame 9.

Second edge 17 as a connecting member is disposed closer to magnetic circuit body 10 than from diaphragm 15. The inner circumferential end of second edge 17 is connected to the outer circumferential surface of voice coil bobbin 12*a* through suspension holder 18 as a connecting member, and the outer circumferential end of second edge 17 is connected to frame 9.

First edge 16 and second edge 17 are symmetric and similar in shape to each other as shown in FIG. 1. In other words, first edge 16 is semicircular in cross section projecting upward, while second edge 17 is semicircular in cross section projecting toward magnetic circuit body 10 (i.e. the opposite direction). Here, first edge 16 and second edge 17 have a nearly equivalent Young's modulus.

As a result that first edge 16 and second edge 17 are shaped so as to project in the direction opposite to each other, and their Young's moduli are nearly equivalent, vertical movable loads exerted by voice coil body 12 on first edge 16 and second edge 17 are approximately equal to each other. Hence, the speaker of the first embodiment can be symmetric in vertical movability of diaphragm 15, reducing distortion contained in sound reproduced.

Here, nonlinearity and/or asymmetry of a movable load on the damper contribute to distortion generated during sound reproduction by the speaker, and thus a damper is eliminated in the speaker of the first embodiment.

Here, a description is made of communication space 19 and first space 20, where space 19 is enclosed by first edge 16, diaphragm 15, voice coil body 12, the top surface of suspension holder 18, the top surface of second edge 17, and upper frame part 9*b*; and space 20 is enclosed by the surface of second edge 17 close to the magnetic circuit body 10, the bottom surface of suspension holder 18, the outer circumferential surface of voice coil body 12, yoke 10*c* (part of magnetic circuit body 10), and lower frame part 9*a*.

First, communication space 19 is formed by first edge 16, diaphragm 15, voice coil body 12, the top surface of suspension holder 18, the top surface of second edge 17, and upper frame part 9*b*. As described above, upper frame part 9*b* is provided therein with openings 9*c*, and thus communication space 19 communicates with outside air.

Meanwhile, first space 20 is not provided with an opening at lower frame part 9*a*, and thus does not communicate with outside air. In other words, first space 20 does not leak air to the outside of frame 9 and is airtight to the atmosphere outside the speaker.

Figure 2:
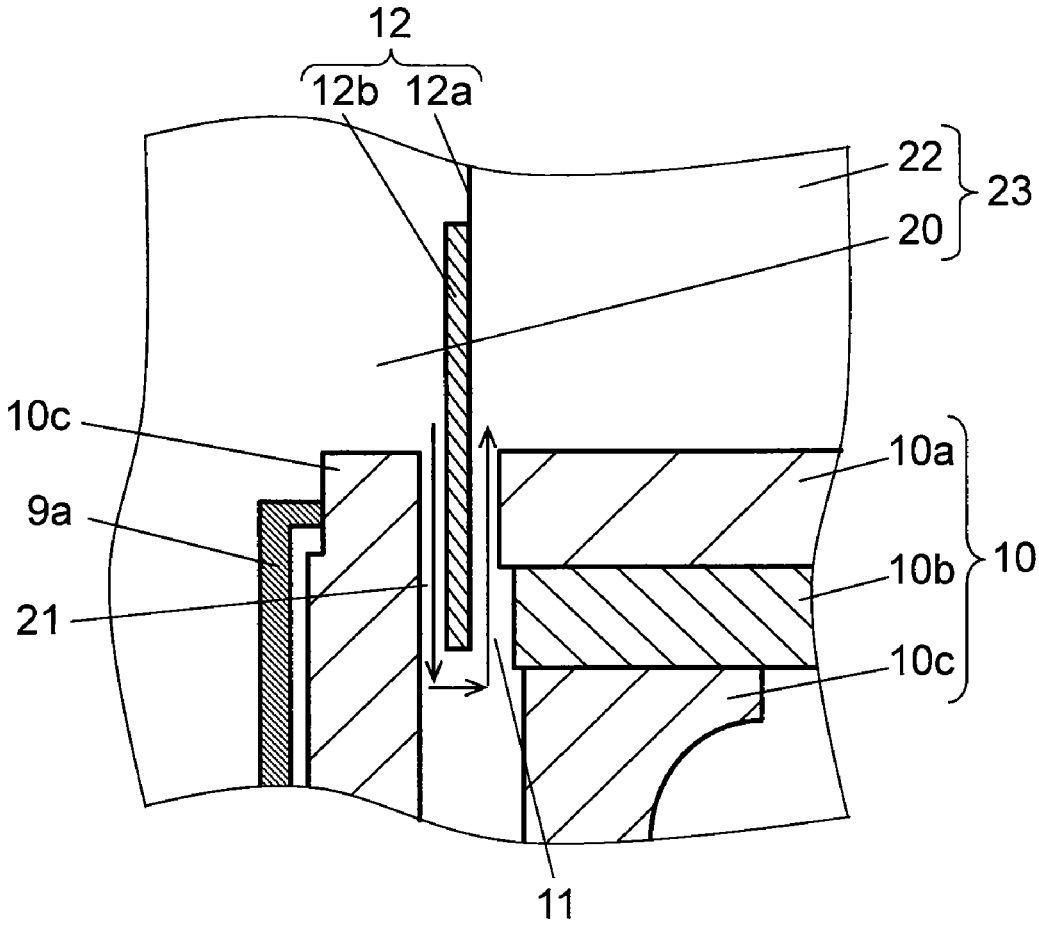
FIG. 2 is an enlarged view of the magnetic gap of the speaker according to the first embodiment of the present invention.

FIG. 2 is an enlarged view of magnetic gap 11 of the speaker according to the first embodiment of the present invention. With the speaker according to the first embodiment in FIG. 2, voice coil body 12 is inserted so as not to contact plate 10*a* or yoke 10*c*, thus making slight gap 21 between plate 10*a* and yoke 10*c*. As shown by the arrows in FIG. 2, gas inside first space 20 may move into and out of second space 22 formed by dust cap 13, voice coil body 12, plate 10*a* (part of magnetic circuit body 10), and diaphragm 15 through gap 21. However, similarly to first space 20, second space 22 is not provided with an opening for communicating with outside air, and thus second space 22 does not leak air to the outside of the speaker.

Hence, although gas can move between first space 20 and second space 22, neither first space 20 nor second space 22 leaks air to the outside of frame 9. First space 20 and second space 22 are hermetically sealed and airtight to the atmosphere outside the speaker.

Next, a description is made of operation and advantages of the speaker according to the first embodiment of the present invention.

An AC current with a sound signal added thereto, when passed through voice coil body 12 of speaker structured as described above, reacts with magnetic gap 11 formed by magnetic circuit body 10, generating a driving force at voice coil body 12. The driving direction is determined by Fleming's left hand rule, and voice coil body 12 fluctuates vertically. The fluctuation of voice coil body 12 causes diaphragm 15 connected to voice coil body 12 to vibrate, which moves air to make the speaker generate sound.

Here, first edge 16 and second edge 17 are structured to support voice coil body 12, and thus normally it is desirable to set a high Young's modulus to first edge 16 and second edge 17 to raise their rigidity.

However, with a high Young's modulus set to first edge 16, it cannot follow vertical amplitude of voice coil body 12 to deform adequately. Consequently, diaphragm 15 connected to first edge 16 deforms, causing disturbance in frequency response in the middle and high ranges.

Thus in the first embodiment, first space 20 enclosed by the surface of second edge 17 (i.e. connecting member) close to magnetic circuit body 10, suspension holder 18, the outer circumferential surface of voice coil body 12, magnetic circuit body 10, and frame 9 is made airtight to the atmosphere outside the speaker. In other words, if first space 20 and second space 22 are hermetically closed, and first space 20 is airtight to the atmosphere outside the speaker as described above, gas inside first space 20 functions as a spring, and first space 20 functions as an air suspension. Consequently, voice coil body 12 is supported with first edge 16 and second edge 17, and with the aid of the springiness of first space 20, which reduces a load exerted on first edge 16 and second edge 17.

Hence, a nearly equivalent, low Young's modulus can be set to first edge 16 and second edge 17. First edge 16 with a low Young's modulus thus being set thereto follows vertical amplitude of voice coil body 12 to deform suitably, which decreases deformation of diaphragm 15 connected to the first edge, thereby reducing disturbance in frequency response in the middle and high ranges.

In the first embodiment, first space 20 communicates with second space 22 through gap 21. Further, second space 22, similarly to first space 20, is airtight to the atmosphere outside the speaker. As a result that the space communicating with first space 20 is thus made airtight to the atmosphere outside the speaker, first space 20 and the space communicating with first space 20 are made function as an air suspension. In other words, in the first embodiment, as a result that second space 22 is made airtight to the atmosphere, and the space of first space 20 and second space 22 combined is made hermetically sealed, and second space 22, in addition to first space 20, is made function as an air suspension.

In the first embodiment, the outer circumferential end of dust cap 13 is connected to diaphragm 15. Instead, another configuration provides the same effect. That is, the outer circumferential end of dust cap 13 is connected to the top end of voice coil bobbin 12*a*; and second space 22 is formed by dust cap 13, voice coil body 12, and plate 10*a* (part of magnetic circuit body 10). Here, it is desirable that second edge 17 has a shape projecting in the direction opposite to diaphragm 15, and first edge 16 has a shape projecting in the direction opposite to second edge 17.

If first edge 16 and second edge 17 are provided so as to project in the direction opposite to each other, diaphragm 15 is unlikely to fluctuate to one side or the other compared to a case of the same direction, resulting in symmetry, which reduces distortion during sound reproduction.

Further, with first edge 16 and second edge 17 made symmetric and similar in shape to each other, vertical fluctuation of diaphragm 15 becomes more symmetric, which further reduces distortion during sound reproduction. To bond together the materials forming first space 20, an adhesive containing modified silicone is desirably used.

Here, first space 20 is formed by bonding together each material of frame 9, second edge 17, suspension holder 18, and voice coil body 12 with an adhesive. To make first space 20 adequately function as an air suspension, air leakage from the bonded parts to the outside of the speaker needs to be minimized.

For this purpose, with an adhesive used primarily containing modified silicone almost free from a volume change after being dried, less air holes are generated after the adhesive is dried, which reduces the possibility of air leakage from the bonded parts between materials to the outside of the speaker.

As well as for first space 20, to bond together each material forming second space 22, an adhesive containing modified silicone is desirably used. Specifically, with an adhesive used primarily containing modified silicone to bond together each material of dust cap 13, diaphragm 15, and voice coil body 12 forming second space 22 in the present invention, the possibility of air leakage is reduced from the bonded parts to the outside of the speaker, which further increases the sealing performance of the space formed by first space 20 and second space 22. Consequently, gas inside the space formed by first space 20 and second space 22 achieves a higher degree of springiness.

Upper frame part 9*b* between first edge 16 and second edge 17 is desirably provided therein with opening 9*c*. The reason is the following. The speaker of the first embodiment has first space 20 hermetically sealed. If communication space 19 is also hermetically sealed in this state, all the spaces enclosed by diaphragm 15 and frame 9 result in a hermetically sealed structure. Consequently, the springiness of the space enclosed by diaphragm 15 and frame 9 suppresses vertical vibration of diaphragm 15 during sound reproduction.

Such suppression reduces low-range output from the speaker, and thus upper frame part 9*b* is provided therein with opening 9*c* in the first embodiment to prevent communication space 19 from being hermetically sealed to make communication space 19 communicate with outside air.

In the first embodiment, a damper is eliminated for reducing distortion contained during sound reproduction by the speaker. However, even with a speaker structured so that the inner circumferential end of the second edge is connected to the voice coil body through a damper, a space enclosed by the second edge surface close to the magnetic circuit body, damper, outer circumferential surface of the voice coil body, magnetic circuit body, and frame can be made airtight to the atmosphere outside the speaker, if the damper is formed of a gas-blocking material, which provides the same advantages as the first embodiment.

Second Exemplary Embodiment

Hereinafter, a description is made of the configuration of a speaker according to the second exemplary embodiment of the present invention using the related drawings.

Figure 3:
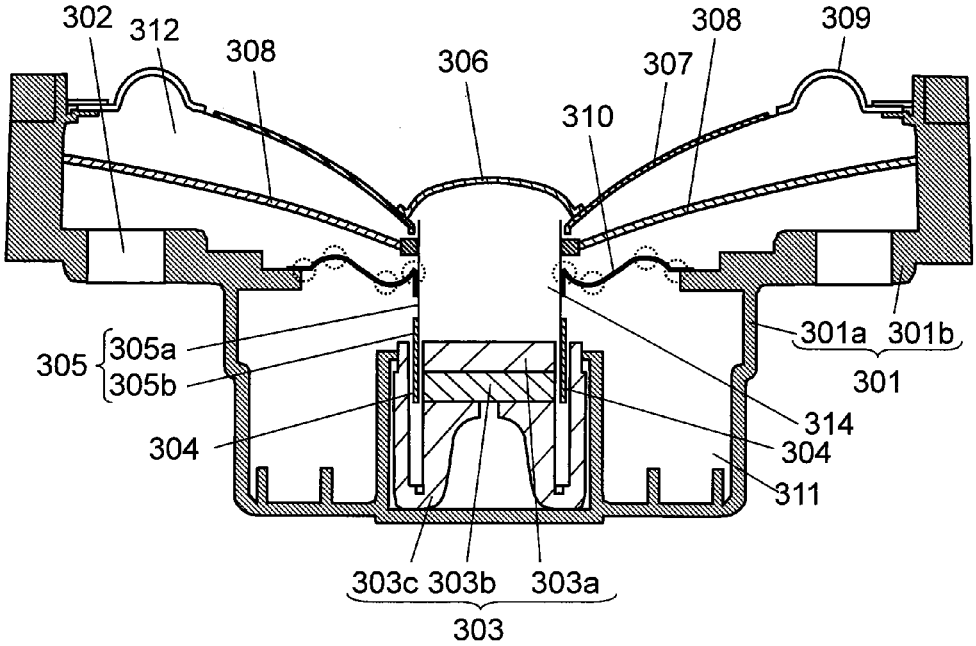
FIG. 3 is a sectional view of a speaker according to the second exemplary embodiment of the present invention.

FIG. 3 is a sectional view of the speaker according to the second embodiment of the present invention. In FIG. 3, the speaker according to the second embodiment of the present invention includes an air-impermeable sealing member as a connecting member instead of a damper in a conventional speaker. The speaker is structured so that a first space and a second space are airtight to the atmosphere outside the speaker. The first space is enclosed by the sealing member surface close to the magnetic circuit body, outer circumferential surface of the voice coil body, magnetic circuit body, and frame. The second space communicates with the first space and is enclosed by the dust cap, inner circumferential surface of the voice coil body, and magnetic circuit body; or by the diaphragm, dust cap, inner circumferential surface of the voice coil body, and magnetic circuit body. In other words, with the speaker according to the present invention, an air-impermeable sealing member hermetically seals gas inside the first and second spaces, which functions as a spring to support the voice coil body with a complex formed of the diaphragm and edge, as well as with the aid of the springiness of gas inside the first and second spaces.

Hence, with the configuration of the present invention, the voice coil body can be supported without a damper (i.e. a movable load on the voice coil body) provided. Consequently, the amplitude of the voice coil body is not restricted by a damper, unlike with a conventional speaker, but the voice coil body faithfully vibrates according to a signal input, and thus the speaker of the present invention reduces distortion during sound reproduction.

Frame 301 of the speaker according to the second embodiment has a shape formed by overlaying bottomed, cylinder-shaped lower frame part 301*a* onto bottomed, dish-shaped upper frame part 301*b* with a diameter larger than that of lower frame part 301*a*. Upper frame part 301*b* is provided therein with openings 302 communicating with outside air.

Magnetic circuit body 303 is placed in the center of the bottom of lower frame part 301*a* and is formed by bonding disk-shaped plate 303*a*, disk-shaped magnet 303*b*, and cylinder-shaped yoke 303*c* in combination. Magnetic circuit body 303 forms cylinder-shaped magnetic gap 304 between the outer circumferential surface of plate 303*a* and the inner circumferential surface of yoke 303*c*.

Voice coil body 305 is formed of cylinder-shaped voice coil bobbin 305*a* and coil 305*b* wound around the outer circumferential surface of voice coil bobbin 305*a*, where coil 305*b* is disposed movably with respect to magnetic gap 304. Above voice coil body 305, hemispherical dust cap 306 is disposed connecting to diaphragm 307 so as to cover the upper opening of voice coil bobbin 305*a*, thereby preventing dust and moisture from ingressing into magnetic gap 304 through the upper opening of voice coil body 305 and preventing a malfunction of the speaker. Here, fine braided wire 308 connected to coil 305*b* is drawn out from the upper part of voice coil body 305 to the outside of frame 301. Through fine braided wire 308, an AC current with a sound signal added thereto is passed from the outside of the speaker to coil 305*b*.

Diaphragm 307 is cone-shaped and its inner circumference is connected to the outer circumferential surface near the top end of voice coil body 305, and its outer circumference is connected to the vicinity of the top end of the inner circumferential surface of upper frame part 301*b* through first edge 309 with a shape projecting upward. Diaphragm 307 generates sound by vertically vibrating during sound reproduction by the speaker, containing mainly pulp and resin balancing high rigidity with low internal loss.

Here, first edge 309 has a shape projecting upward so as not to exert a movable load on voice coil body 305 during sound reproduction by the speaker and is formed of a material such as urethane foam resin, foamed rubber, SBR rubber, and cloth.

Sealing member 310 as a connecting member has a ring-shaped flat surface and a nearly S-shaped cross section. The inner circumference of sealing member 310 is connected to voice coil bobbin 305*a* between fine braided wire 308 and coil 305*b*, and the outer circumference is connected to frame 301. Sealing member 310 is made of a material with high elasticity and flexibility, and with air impermeability, where such as a rubber-based material and vinyl material is preferable. Besides, an appropriate material coated with rubber for air impermeability may be used.

However, sealing member 310 has high elasticity and flexibility only around the frame 301 junction and voice coil bobbin 305*a* junction, and at the nearly S-shaped projections, shown by the dotted-line circles in FIG. 3, while the other portions are formed being close to a rigid body. In other words, sealing member 310 is not uniformly elastic or flexible, that is some parts are higher in elasticity and flexibility than others. With such a structure, the parts marked by the dotted-line circles deform while voice coil body 305 is vibrating to allow sealing member 310 to follow vibration of voice coil body 305.

Further, the reason why the parts not marked by the dotted-line circles are formed being close to a rigid body is to efficiently receive an air pressure exerted by a hermetically closed space (described later) to make the space effectively function as an air suspension. Specifically, sealing member 310 having uniform, high elasticity and flexibility does not withstand an air pressure exerted from the hermetically closed space while voice coil body 305 is vibrating, disabling sealing member 310 to maintain an appropriate shape. Hence, in the second embodiment, the parts not marked by the dotted-line circles are formed being close to a rigid body to enable sealing member 310 to maintain an appropriate shape while voice coil body 305 is vibrating, thereby making the hermetically closed space effectively function as an air suspension.

In the second embodiment, relatively low elasticity and flexibility are set to the parts shown by the dotted-line circles in FIG. 3 as described above. However, the present invention is not limited to the setting, but low elasticity and flexibility may be set to only the vicinity of the frame 301 junction and voice coil bobbin 305*a* junction, for instance.

Next, a description is made of a hermetically closed space formed by sealing member 310.

As described above, with sealing member 310 being air-impermeable, first space 311 enclosed by the surface of sealing member 310 close to magnetic circuit body 303, the outer circumferential surface of voice coil body 305, yoke 303*c* (part of magnetic circuit body 303), and lower frame part 301*a* does not communicate with outside air, and is airtight to the atmosphere outside the speaker. With frame 301 provided therein with opening 302, communication space 312 enclosed by first edge 309, diaphragm 307, voice coil body 305, the top surface of sealing member 310, and upper frame part 301*b* communicates with the atmosphere outside the speaker. However, sealing member 310 stops gas from moving between first space 311 and communication space 312, preventing gas inside first space 311 from leaking to the atmosphere outside the speaker.

Figure 4:
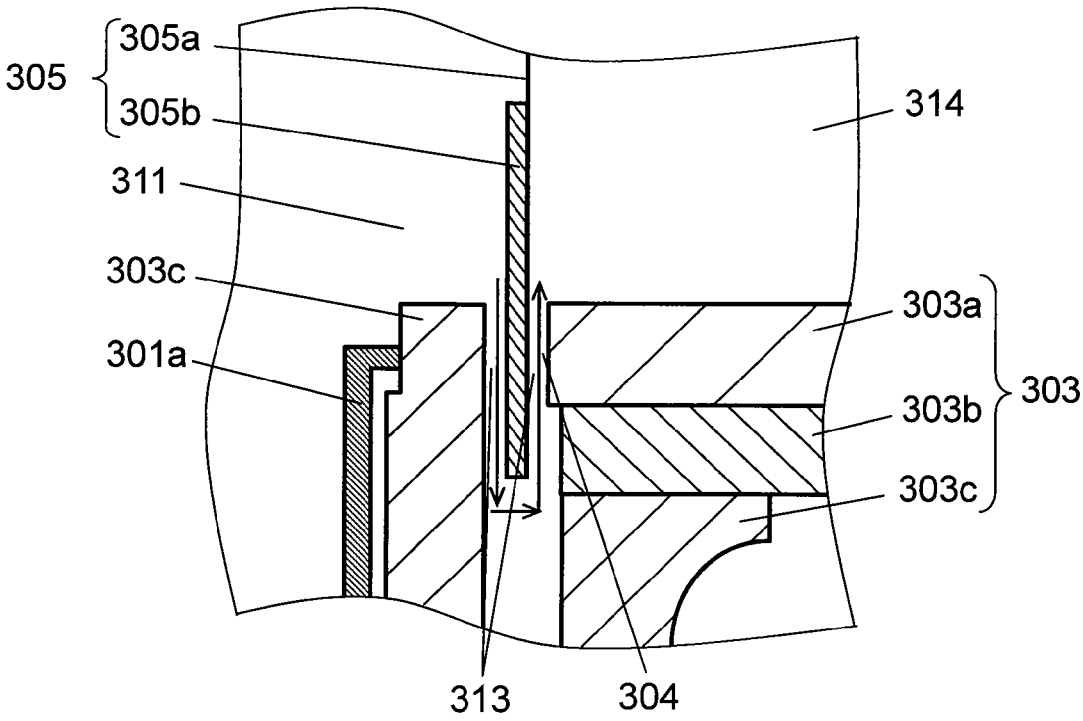
FIG. 4 is an enlarged view of the magnetic gap of the speaker according to the second embodiment of the present invention.
Figure 5:
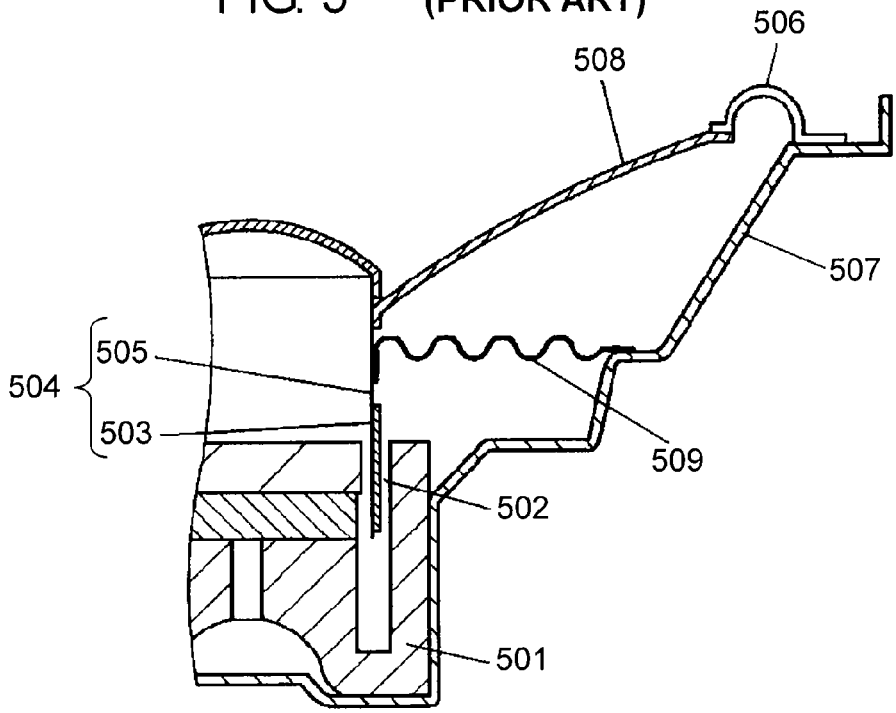
FIG. 5 (PRIOR ART)
FIG. 5 is a sectional view of a conventional speaker.
Figure 6:
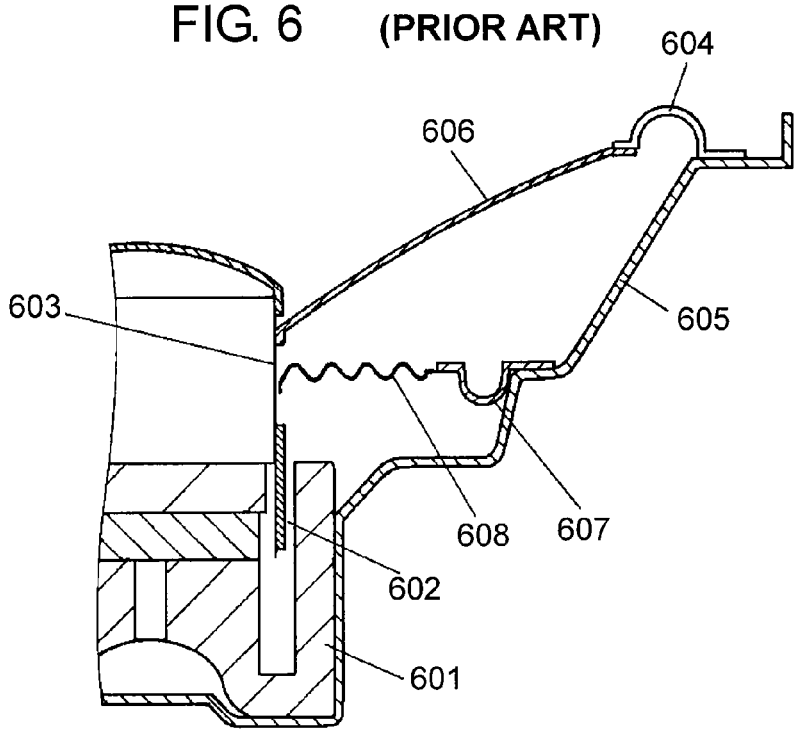
FIG. 6 (PRIOR ART)
FIG. 6 is a sectional view of another conventional speaker.

FIG. 4 is an enlarged view of magnetic gap 304 of the speaker according to the second embodiment of the present invention. In FIG. 4, coil 305*b* of voice coil body 305 is inserted into magnetic gap 304 so as not to contact plate 303*a* or yoke 303*c* in the second embodiment, and thus making slight gap 313 between coil 305*b* and plate 303*a*, and between coil 305*b* and yoke 303*c*. As indicated with the arrow in FIG. 4, gas inside first space 311 may move through gap 313 into and out of second space 314 formed from dust cap 306, voice coil body 305, plate 303*a* (part of magnetic circuit body 303), and diaphragm 307. However, similarly to first space 311, an opening is not provided for making second space 314 communicate with outside air, and thus air does not leak from second space 314 to the outside of the speaker.

Hence, although gas can move between first space 311 and second space 314 in the second embodiment, gas inside both first space 311 and second space 314 does not leak to the atmosphere outside frame 301, and thus first space 311 and second space 314 are airtight to the atmosphere outside the speaker.

Next, a description is made of operation and advantages of the speaker according to the second embodiment of the present invention.

An AC current with a sound signal added thereto, when passed through voice coil body 305*b* of the speaker structured as described above, reacts with magnetic gap 304 formed by magnetic circuit body 303, generating a driving force at voice coil body 305. The driving direction is determined by Fleming's left hand rule, and voice coil body 305 vibrates vertically. The vibration of voice coil body 305 causes diaphragm 307 connected to voice coil body 305 to vibrate, which moves air to make the speaker reproduce sound. With a conventional speaker, a corrugated damper is connected to the voice coil body to make it easy to follow vibration of the voice coil body during sound production by the speaker.

However, vibration of the voice coil body larger than a given level prevents the damper from completely following the vibration, rapidly increasing a movable load on the voice coil body, which makes it difficult for the voice coil body to vibrate faithfully according to an input signal. Consequently, as long as the voice coil body is supported with the damper, sound reproduced by the speaker results in containing distortion.

Hence in the second embodiment, sealing member 310 is provided instead of a damper and is air-impermeable. First space 311 and second space 314 are airtight to the atmosphere outside the speaker, where first space 311 is enclosed by the surface of sealing member 310 close to magnetic circuit body 303, the outer circumferential surface of voice coil body 305, yoke 303*c* (part of magnetic circuit body 303), and lower frame part 301*a*; second space 314 is enclosed by dust cap 306, voice coil body 305, plate 303*a* (part of magnetic circuit body 303), and diaphragm 307.

With first space 311 and second space 314 being thus airtight to the atmosphere outside the speaker, gas inside first space 311 and second space 314 exhibits a function as a spring, and first space 311 and second space 314 function as an air suspension. Consequently, in the second embodiment, without a damper provided, unlike in a conventional speaker, voice coil body 305 is adequately supported with a complex of first edge 309 and diaphragm 307, and with the aid of the springiness of first space 311 and second space 314.

As described above, sealing member 310 has high flexibility and elasticity at the parts marked by the dotted-line circles in FIG. 3, and thus sealing member 310 does not restrain voice coil body 305 from vibrating vertically during sound reproduction by the speaker, and sealing member 310 does not exert a movable load on voice coil body 305, unlike with a conventional speaker.

Consequently, voice coil body 305 vibrates faithfully according to an input signal, thereby reducing distortion contained during sound reproduction by the speaker.

In the second embodiment, the outer circumferential end of dust cap 306 is connected to diaphragm 307, and second space 314 is a space enclosed by diaphragm 307, dust cap 306, voice coil body 305, and magnetic circuit body 303. Instead, another configuration provides the same effect. That is, the outer circumferential end of dust cap 306 is connected to the top end of voice coil bobbin 305*a*; and second space 314 is formed by dust cap 306, voice coil body 305, and plate 303*a* (part of magnetic circuit body 303). To bond together the materials forming first space 311, an adhesive containing modified silicone is desirably used.

Here, first space 311 is formed by bonding together each material of sealing member 310, voice coil body 305, magnetic circuit body 303, and frame 301 with an adhesive. To make first space 311 adequately function as an air suspension, air leakage from the bonded parts to the outside of the speaker needs to be minimized.

For this purpose, with an adhesive used primarily containing modified silicone almost free from a volume change after being dried, less air holes are generated after the adhesive is dried, which reduces the possibility of air leakage from the bonded parts between materials to the outside of the speaker.

As well as for first space 311, to bond together the materials forming second space 314, an adhesive containing modified silicone is desirably used. Specifically, with an adhesive used primarily containing modified silicone to bond together each material of dust cap 306, diaphragm 307, and voice coil body 305 forming second space 314 in the present invention, the possibility of air leakage is reduced from the bonded parts to the outside of the speaker, which results in a higher degree of springiness of gas inside the space formed of first space 311 and second space 314.

INDUSTRIAL APPLICABILITY

A speaker according to the present invention enables supporting the voice coil body with a complex of the diaphragm and edge, and a connecting member, with the aid of gas springiness. More specifically, the speaker according to the present invention does not include a damper that causes a movable load on the voice coil body, to allow the voice coil body to vibrate faithfully according to an input signal, thereby reducing distortion contained during sound reproduction by the speaker. Hence, the present invention is suitably applicable to various types of audio equipment.

The invention claimed is:

1. A speaker comprising:

a frame;

a magnetic circuit body supported by the frame;

a voice coil body placed in a magnetic gap formed by the magnetic circuit body, with a coil part of the voice coil body movably disposed;

a dust cap placed so as to block an opening of a voice coil bobbin of the voice coil body;

a diaphragm placed on an outer circumferential surface of the voice coil bobbin of the voice coil body, with an inner circumference of the diaphragm connected to the outer circumferential surface;

a first edge provided at an outer circumference of the diaphragm, with an inner circumference of the first edge connected to the outer circumference, and with an outer circumference of the first edge connected to the frame; and a connecting member placed closer to the magnetic circuit body than from the diaphragm, with an inner circumferential end of the connecting member connected to the outer circumferential surface of the voice coil bobbin of the voice coil body, and with an outer circumferential end of the connecting member connected to the frame, wherein a first space enclosed by a surface of the connecting member close to the magnetic circuit body, the outer circumferential surface of the voice coil bobbin, the magnetic circuit body, and the frame is airtight to an atmosphere outside the speaker, wherein the first space is an air suspension, and wherein the connecting member is an air-impermeable sealing member, the air-impermeable sealing member having a high elasticity and flexibility.

2. The speaker of claim 1, further comprising a second space communicating with the first space, the second space being enclosed by the dust cap, an inner circumferential surface of the voice coil body, and the magnetic circuit body; or by the diaphragm, the dust cap, the inner circumferential surface of the voice coil body, and the magnetic circuit body, wherein the first space and the second space are airtight to the atmosphere outside the speaker, and wherein the first space and the second space are air suspensions.

3. The speaker of claim 1, wherein a member forming the first space is bonded with an adhesive containing a modified silicone.

4. The speaker of claim 1, wherein a member forming the first space and the second space is bonded with an adhesive containing a modified silicone.

5. The speaker of claim 1, wherein the air-impermeable sealing member has the high elasticity and flexibility around a junction of the air-impermeable sealing member with the frame and a further junction of the air-impermeable sealing member with the voice coil bobbin.

6. The speaker of claim 1, wherein the air-impermeable sealing member is nearly S-shaped.

7. The speaker of claim 6, wherein the air-impermeable sealing member has the high elasticity and flexibility at S-shaped projections of the air-impermeable sealing member.

* * * * *